US006196937B1

(12) United States Patent
Kuttappa

(10) Patent No.: US 6,196,937 B1
(45) Date of Patent: Mar. 6, 2001

(54) THREE PIECE GOLF BALL

(76) Inventor: Sanjay M. Kuttappa, 109 Creekview Dr., Clemson, SC (US) 29631

( * ) Notice: Subject to any disclaimer, the term of this patent is extended or adjusted under 35 U.S.C. 154(b) by 0 days.

(21) Appl. No.: 09/238,398

(22) Filed: Jan. 27, 1999

Related U.S. Application Data

(60) Provisional application No. 60/073,656, filed on Feb. 4, 1998.

(51) Int. Cl.[7] ..... A63B 37/00

(52) U.S. Cl. ..... 473/351; 264/250; 264/251; 264/254; 264/255; 473/356; 473/357; 473/373; 473/374; 473/375; 473/376; 473/377; 473/378; 473/385

(58) Field of Search ..... 473/356, 357, 473/373, 374, 375, 376, 377, 378, 385; 264/250, 251, 254, 255

(56) References Cited

U.S. PATENT DOCUMENTS

| | | | | |
|---|---|---|---|---|
| 3,112,521 | | 12/1963 | Ward . | |
| 3,147,324 | | 9/1964 | Ward . | |
| 3,177,280 | | 4/1965 | Ford et al. . | |
| 4,337,946 | * | 7/1982 | Saito et al. | 273/225 |
| 5,334,673 | | 8/1994 | Wu . | |
| 5,421,580 | | 6/1995 | Sugimoto et al. . | |
| 5,445,387 | * | 8/1995 | Maruko et al. | 273/216 |
| 5,586,950 | * | 12/1996 | Endo | 473/356 |
| 5,628,699 | | 5/1997 | Maruko et al. . | |
| 5,704,852 | * | 1/1998 | Kuto et al. | 473/357 |
| 5,759,676 | * | 6/1998 | Cavallaro et al. | 428/215 |
| 5,810,677 | * | 9/1998 | Maruko et al. | 473/357 |
| 5,816,939 | * | 10/1998 | Hamada et al. | 473/357 |
| 5,827,167 | * | 10/1998 | Dougan et al. | 473/356 |
| 5,939,184 | * | 8/1999 | Inoue | 428/331 |
| 5,980,396 | * | 11/1999 | Moriyama | 473/376 |
| 6,001,930 | * | 12/1999 | Rajagopalan | 525/92 B |
| 6,015,356 | * | 1/2000 | Sullivan | 473/373 |
| 6,045,460 | * | 4/2000 | Hayashi | 473/376 |

FOREIGN PATENT DOCUMENTS

| | | |
|---|---|---|
| 0 674 923 A1 | 10/1995 | (EP) . |
| 2 301 291 | 12/1996 | (GB) . |
| 2 301 779 | 12/1996 | (GB) . |
| 2 307 865 | 6/1997 | (GB) . |

* cited by examiner

*Primary Examiner*—Lee Young
*Assistant Examiner*—Paul Kim

(57) ABSTRACT

A thread-wound golf ball comprising a large, heavy center with rubber thread windings and a cover is disclosed. The center has a diameter of about between 1.40" and 1.53", a weight of about between 24–34 g and a deformation of about between 0.080–0.160" when subjected to a 200 lb. load. The cover is a thermosetting or thermoplastic material with a hardness range between 40–70 Shore D. A golf ball according to the invention exhibits the combined superior characteristics of two-piece and three-piece golf balls, i.e., ease of manufacture, feel, playability, durability and distance travel.

14 Claims, 1 Drawing Sheet

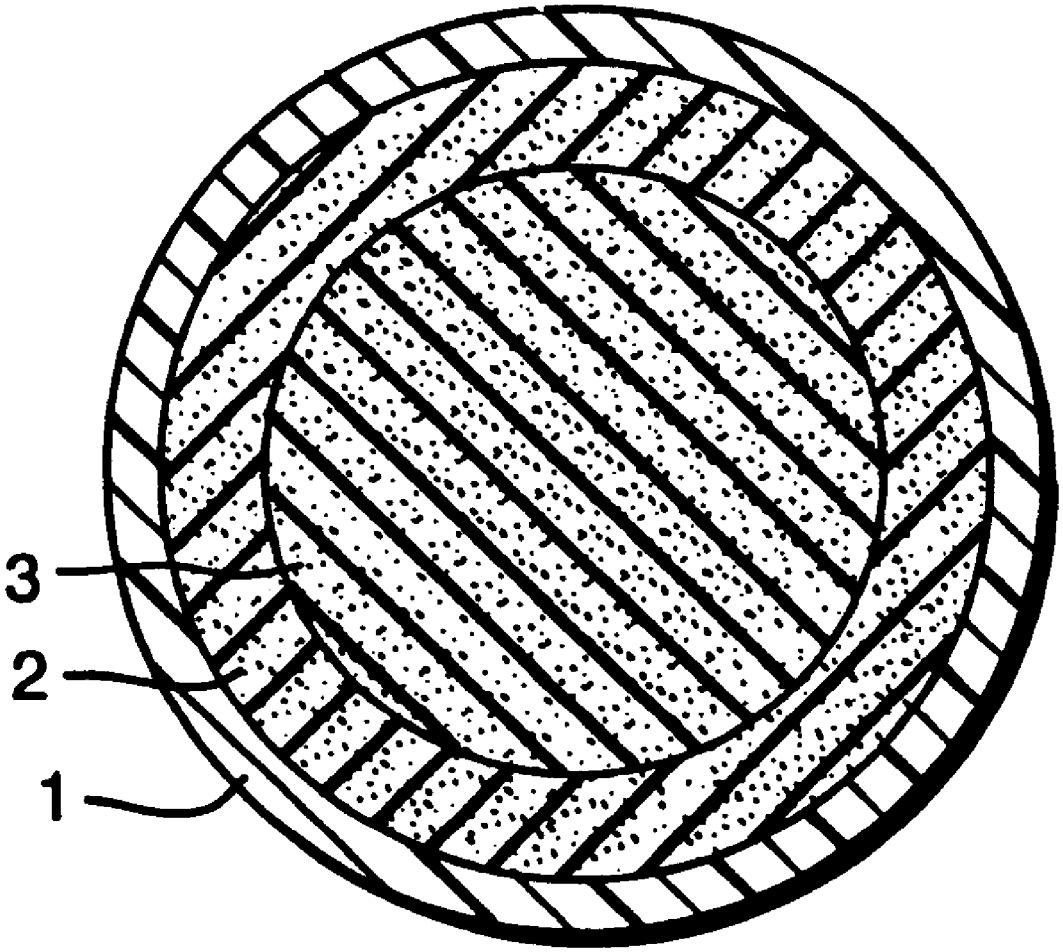
3
2
1

THREE PIECE GOLF BALL

CROSS-REFERENCE TO RELATED APPLICATION

A claim of priority is made to U.S. Provisional Application Serial No. 60/073,656, filed Feb. 4, 1998, the contents of which are incorporated herein by reference.

BACKGROUND OF THE INVENTION

1. Field of the Invention

This invention relates to thread wound golf balls. More specifically, it relates to thread wound golf balls having large centers that provide improved manufacturability and playability characteristics.

2. Description of the Related Art

Until the late 1960's, most golf balls were constructed with a thread wound core and a cover of compounds based on natural (balata and gutta percha) or synthetic transpolyisoprene. These golf balls have been and are still known to provide acceptable flight distance. Additionally, due to the relative softness of the balata cover, skilled golfers are able to impart various spins on the ball in order to control the ball's flight path (e.g., "fade" or "draw") and "bite" characteristics upon landing on a green.

With the advent of new materials developed through advances and experimentation in polymer chemistry, two-piece golf balls have been developed. The primary difference between a two-piece golf ball and a three-piece golf ball is the elimination of the rubber thread windings found in the three-piece balls. A relatively large center in a two-piece ball takes the place of the relatively small center and thread windings of a three-piece ball having the same overall diameter.

The two-piece balls have proven to be superior to three-piece balls in the areas of distance and durability. With respect to durability, the balls have proven to be more durable when repeatedly struck with golf clubs and more durable when exposed to a variety of environmental conditions such as high heat when stored, for example, in an automobile trunk. However, two-piece balls are, in general, considered to have inferior characteristics of feel and workability when compared to three-piece balls.

Attempts have been made to blend the characteristics of a three-piece ball with those of a two-piece ball. For example, a three-piece golf ball having a relatively large center is disclosed in UK Patent Application No. GB 2 307 865 A to Sano. In this UK patent application, a thread wound golf ball is disclosed having a center made of a vulcanized rubber composition with a diameter of between 30 and 38 millimeters. The center exhibits a deformation amount of between 1.2–2.5 millimeters or 0. 047–0.098 inches when a load of between 10 Kg initial and 30 Kg final is applied. The cover is composed of an ionomer resin, a maleic anhydride-modified thermoplastic resin and an epoxidated thermoplastic resin having a JIS-A hardness of from 30 to 90.

Although exhibiting some favorable characteristics of two-piece and three-piece balls, the center's deformation amount is too high to provide the launch characteristics of a true two-piece ball. Furthermore, the ionomer-based cover material, as is well known, will not produce the same playability characteristics of a three-piece ball with a balata cover even though the cover should exhibit superior durability characteristics.

Another attempt at blending the characteristics of two-piece and three piece balls is described in European Patent Application 0 674 923 A1 to Kato. In the Kato application, a wound golf ball is disclosed having a center composed of a vulcanized rubber composition having a diameter of between 30 and 35 millimeters. The center is described as having a deformation amount of between 1.2–2.5 millimeters or 0.047–0.098 inches when a load of between 10 Kg initial and 30 Kg final is applied.

Like the Sano reference, the Kato wound ball's center's deformation amount is too high to provide the launch characteristics of a true two-piece ball. Furthermore, the higher part of the described diameter range is not sufficient to impart the favorable characteristics of a true two-piece ball.

A still further attempt to combine the best characteristics of two-piece and three-piece balls is set forth in U.K. Patent Application No. GB 2 301 779 A to Maruko. The Maruko reference discloses a thread-wound golf ball wherein the center has a diameter of between 30 to 35 millimeters and a weight of between 19.5 to 29.0 g. The golf ball is described as having a deformation amount of between 2.5–3.7 millimeters or 0.098–0.146 inches when subjected to a 100 Kg load. The center has an intrinsic frequency of from 2,000–4,000 Hz when dropped 120 cm onto a steel plate. This golf ball design suffers from the same set backs as the previously described golf balls.

The primary problem with all the recited golf balls is that the centers are not large enough to move the weight to the periphery to provide sufficient moment of inertia to maximize distance without compromising ball velocity. To maintain ball velocity while increasing distance travel, the material used out of necessity must have high resilience. The golf balls disclosed do not have this combination of a large center made with materials exhibiting high resilience characteristics.

It has now been discovered that a relatively large, heavy center can be constructed of high resilience materials to increase the moment of inertia of a golf ball to increase distance travel. In combination with the other golf ball components, i.e., thread windings and an appropriately selected cover, distance maximization can be achieved without compromising ball initial velocity, PGA compression or shot feel and control.

Apart from the center composition and size, one of the key components to the invention is the material used for the cover. For many years, balata-based compounds were the material of choice to construct golf ball covers. Though possessing many desirable properties such as being readily adaptable to molding, there are substantial drawbacks to use of balata or transpolyisoprene-based compounds for golf ball covers. From a manufacturing standpoint, balata-type materials are expensive and the manufacturing procedures used are time consuming and labor-intensive, thereby adding to the material expense. From a player's perspective, golf balls constructed with balata-based covers are very susceptible to being cut from mishits and being sheared from "sharp" grooves on a club face. As a result, they have a relatively short life span.

In response to these drawbacks to balata-based golf ball covers, the golf ball manufacturing industry has shifted to the use of synthetic thermoplastic materials, most notably ionomers sold by E. I. DuPont De Nemours & Company under the name SURLYNO®.

Thread wound balls with ionomer covers are less costly to manufacture than balls with balata covers. They are more durable and produce satisfactory flight distance. However, these materials are relatively hard compared to balata and thus lack the "click" and "feel" of a balata covered golf ball. "Click" is the sound emitted from the impact of a golf club head on a golf ball. "Feel" is the overall sensation transmitted to the golfer through the golf club after striking a golf ball.

In an attempt to overcome the negative factors of the hard ionomer covers, DuPont introduced low modulus SURLYN® ionomers in the early 1980's. These SURLYN ionomers have a flexural modulus of from about 3000 to about 7000 PSI and hardness of from 25 to about 40 as measured on the Shore D scale—ASTM 2240. The low modulus ionomers are terpolymers, typically of ethylene, methacrylic acid and n- or iso-butylacrylate, neutralized with sodium, zinc, magnesium or lithium cations. E. I. DuPont De Nemours & Company has disclosed that the low modulus ionomers can be blended with other grades of previously commercialized ionomers of high flexural modulus from about 30,000 to 55,000 PSI to produce balata-like properties. However, "soft" blends, typically 52 Shore D and lower (balata-like hardness), are still prone to cut and shear damage.

The low modulus ionomers when used without blends, produce covers with very similar physical properties to those of balata, including poor cut and shear resistance. Worse, wound balls with these covers tend to go "out-of-round" quicker than wound balls with balata covers. Blending with hard SURLYN ionomers was found to improve these properties. It has been found that use of any of the balata or ionomer-based cover compounds do not provide the desired combination of superior playability, durability and amalgamation characteristics when combined with the large center of the present invention even though these cover materials can be used with the invention.

Another approach taken to provide a golf ball cover that has the playing characteristics of balata without the inferior durability characteristics is described in U.S. Pat. No. 5,334,673 ("the '673 patent") assigned to the Acushnet Company. The '673 patent discloses a urethane cover composition comprising a diisocyanate, a polyol and a slow-reacting polyamine curing agent. The diisocyanates claimed in the '673 patent are relatively fast reacting. Due to this fact, catalysts are not needed to lower the activation energy threshold. However, since relatively fast-reacting prepolymer systems are used, the reaction rate cannot be easily controlled thereby requiring the implementation of substantial processing controls and precise reactant concentrations in order to obtain a desired product.

To avoid the problems associated with fast-reacting prepolymer systems, slow-reacting systems such as Toluene diisocyanate (TDI) prepolymer systems can be employed. However, these systems, while avoiding the problems associated with fast-reacting systems, present similar problems, albeit for different reasons. The most noteworthy problem with slow-reacting pre-polymer systems is the requirement for a catalyst.

By introducing a catalyst into the system, processing problems similar to those associated with fast-reacting prepolymer systems are virtually inevitable. As is well known in the art, the use of a catalyst can severely restrict the ability to control the speed of the reaction, which is undesirable.

Along with the use of a large center, it has now also been discovered that a blend of diamine curing agents with slow reacting prepolymer systems eliminates the problems associated with catalysts while maintaining the advantages associated with slow-reacting prepolymer systems. This cover material has demonstrated superior amalgamation properties when combined with the materials used for the large center. It has been discovered that the combination of this cover material with the large, heavy center and, of course, reduced rubber windings provides a golf ball having all the desirable characteristics of two-piece and three-piece balls without any of the drawbacks associated with the two different types of golf balls.

Accordingly, it is an object of this invention to provide a golf ball that exhibits all the combined desirable characteristics of two-piece and three-piece golf balls such as superior flight distance, good initial velocity, PGA compression and shot feel and control.

Another object of the invention is to lower the cost of manufacture by reducing the amount of thread material needed to make a regulation size golf ball.

A further object of the invention is to employ a cover material that has superior cut and shear resistance. A still further object of the invention is to provide a cover material that exhibits superior amalgamation properties with the other components of the golf ball to thereby increase durability.

SUMMARY OF THE INVENTION

The invention described and claimed herein is a golf ball comprised of a large, heavy center, rubber thread windings and a cover. The center has a diameter of between 1.40–1.53" or 35.6–38.9 millimeters and is comprised of materials that exhibit high resilience properties. The thread windings are made of materials typically used in the golf ball manufacturing industry for thread windings.

The cover can be constructed from balata, ionomer-based compounds, urethane compounds or any other suitable thermosetting or thermoplastic material.

Thermoplastic materials are materials that melt at a given temperature and can be formed into any shape by heat and pressure at their melted state and upon cooling will retain the shape or form intended. They do not have any crosslinks unlike thermosets and can therefore be melted or reformed with heat at their melt temperature. Examples of these are ionomers, thermoplastic elastomers (TPEs) and thermoplastic urethanes (TPUs). On the other hand thermosets are materials that flow upon heat and pressure but will cure or vulcanize during this process to form chemical crosslinks. On cooling or once formed this material cannot be remelted due to the crosslinks which also provide better strength and tensile properties. Examples of such materials are cured Balata (trans-polyisoprene), Rubbers and urethanes. Any further detail is beyond the scope of this patent as it relates to the size and performance of the center in three piece wound golf balls.

The present invention provides a golf ball composition that exhibits the desirable characteristics of both two-piece and three-piece golf balls, i.e., superior manufacturability, durability, feel, distance travel and playability. These and other objects and features of the present invention will be apparent from a reading of the following detailed description of the invention.

BRIEF DESCRIPTION OF THE DRAWINGS

FIG. 1 is a sectional view of a golf ball made in accordance with one embodiment of the invention.

DETAILED DESCRIPTION OF THE INVENTION

One of the physical properties affecting golf ball distance travel is the moment of inertia. By increasing the moment of inertia, the distance a golf ball travels after being struck is increased proportionally to the increase in the moment of inertia.

One of the ways to increase the moment of inertia is to increase the size of the golf ball center. As is known in the art, two-piece golf balls have larger centers than three-piece balls which have the same overall diameter. As a result, two-piece balls typically carry further distances than three-piece balls when struck with equal force. By making the center larger, the weight distribution in the ball is affected such that the moment of inertia is increased.

One of the problems with increasing the size of the center is the loss of substantial ball resilience which ultimately affects initial ball velocity. One of the keys to the present invention is to select materials for the center that do not compromise desired resiliency when utilized in a large diameter center.

It has been discovered that a combination of high-cis polybutadiene, natural and/or polyisoprene rubber, zinc acrylate salt with weight enhancing materials and curatives provides a composition that can be used to make a large diameter center that has sufficient size and weight to effectively increase the moment of inertia to a point where a thread wound golf ball made with such a center has distance travel characteristics similar to a two-piece ball. As used herein, "high-cis" shall mean about 96% or higher of the cis content of the particular polymer.

In a preferred embodiment, the golf ball center is made of a rubber composition comprising: 80–100 PPHR (parts per 100 parts by weight of the rubber in the composition) of high-cis polybutadiene, 0–20 PPHR of natural and/or polyisoprene rubber, 10–30 PPHR of zinc acrylate salts, 0–50 PPHR of weight enhancing materials (fillers), and 0.5–5 PPHR of curatives.

In a preferred embodiment, 95 PPHR of high-cis 1,4-polybutadiene, 5 PPHR polyisoprene, 20 PPHR zinc acrylate, 27 PPHR zinc oxide, 0.5 PPHR 2,2,4 trimethyl-1,2, hydroquinoline (an anti-oxidant), 3 PPHR zinc stearate (used as a processing aid) and 2.5 PPHR di-cumyl peroxide as the curative is used to produce a golf ball center having the desired characteristics described heretofore.

The weight enhancing materials or fillers used are selected on the basis of specific gravity. In a preferred embodiment, the filler should have a specific gravity of about 4.3 or greater. Zinc oxide, Barium sulfate, Tungsten or mixtures of the three are examples of suitable fillers.

The curatives used can be any of a variety of peroxides. The most important characteristic of the peroxide is its decomposition rate expressed by its half life ($t_{1/2}$). The half life is the time required for one half of the molecules of a given amount of peroxide (or its blend) at a certain temperature to decompose. The peroxide (or its blend) that would work in the present system is one that has a "one hour" half life between 94 and 154° C. Di-cumyl peroxide has a one hour half life of 132° C. Dialkyl peroxides, peroxyesters, peroxyketals, alone or in combination, can be used as the curing agent to produce a golf ball center having the desired physical properties. As set forth above, di-cumyl peroxide, a dialkyl peroxide, is the preferred is curing agent. Furthermore, a sulfur based cure system may also be employed (if necessary) to achieve the desired center properties. The sulfur based cure system is selected from the group consisting of elemental sulfur, chemical accelerators and blends thereof.

The center is manufactured by using conventional compression molding processes. The components are mixed together and extruded to form preforms which are then placed in cavities in the mold and compression molded under pressure and cured/vulcanized to form centers. The same mix may also be injection molded. Curing is carried out in the mold at temperatures of 280–380° F. for 5–20 minutes depending on the compound.

A center made in accordance with the invention will have a center diameter of about between 1.40" and 1.53" with a weight range of about between 24–34 g. The center will also have a deformation of about between 0.080" and 0.160" (i.e., 20–100 PGA), when subjected to a 200 lb. load and a rebound of not less than 70% of a height from which the center is dropped onto a rigid substrate such as a granite slate.

Once the center has been made, the rubber threads are wound around the center until the rubber thread windings reach a thickness of about between 0.10" to 0.23" or between 0.025" to 0.110". In a preferred embodiment, the rubber threads are a vulcanized article made of natural and/or synthetic rubber such as polyisoprene.

Following preparation of the center with windings, the subassembly is ready for the application of a cover. The cover material can be made of balata or any suitable ionomer-based is material such as SURLYN®. However, it has been found that a urethane-based material provides a cover with superior characteristics of playability and durability relative to covers made with balata and ionomer-based covers. Ultimately, any thermoset of thermoplastic material can be used which has a hardness range of about between 40 to 70 Shore D.

Regarding the advantages of using a large center for a golf ball, the following example illustrates the beneficial effects.

Test No. 1

The following test was conducted on two golf balls having the following characteristics. The windings, the diameter of the wound core (1.580") and the cover material (urethane) and thickness were maintained the same for both golf balls. The only altered feature was the diameter of the center. The diameter for the center of the conventional golf ball was set at 1.125". The diameter for the center of the other golf ball was set at 1.420".

| | BALL #1 (Conventional) | BALL #2 (Large Center) |
|---|---|---|
| BALL PHYSICALS | | |
| Center Size (diameter in inches) | 1.125 | 1.420 |
| Center Weight (grams) | 17.5 | 29.8 |
| Ball Weight (grams) | 46.0 | 45.4 |
| Ball Compression (PGA) | 83.4 | 84.0 |
| Ball Initial Velocity (ft/s) | 254.7 | 255.0 |
| Calculated Ball Moment of Inertia (oz-in2) | 0.4385 | 0.4529 |
| Actual Ball Moment of Inertia (oz-in2) | 0.4253 | 0.4322 |

-continued

| | BALL #1 (Conventional) | BALL #2 (Large Center) |
|---|---|---|
| FLIGHT DATA (DRIVER) | | |
| Carry (yards) | 233.8 | 243.3 |
| Total (yards) | 237.5 | 243.3 |
| Launch Angle (°) | 8.5 | 9.0 |
| Spin (rpm) | 3762 | 3043 |
| FLIGHT DATA (5 Iron) | | |
| Carry (yards) | 162.8 | 170.3 |
| Launch Angle (°) | 11.0 | 11.4 |
| Spin (rpm) | 5706 | 4798 |

As conclusively demonstrated by the preceding results, golf balls which utilize a larger diameter center experience a marked increase in moment of inertia. The golf ball having the higher moment of inertia also exhibited a lower spin rate at the time of launch and a higher launch angle which translates into longer flight distance. It is surmised that the longer distance is due to less spin decay during flight with respect to golf balls having a higher moment of inertia. The benefits of such performance characteristics are most pronounced when a driver is used to strike the golf ball. In short, a wound golf ball having a large diameter center provides the desirable enhanced performance characteristics of higher moment of inertia, lower initial spin rate, lower spin decay during ball flight, lower launch angle and longer flight distance.

It will be appreciated that the instant specification and claims are set forth by way of illustration and do not depart from the spirit and scope of the present invention. It is to be understood that the present invention is by no means limited to the particular embodiments herein disclosed, but also comprises any modifications or equivalents within the scope of the claims.

Having thus described my invention, what I claim as new and desire to secure by United States Letters Patent is:

1. A method of constructing a thread-wound golf ball comprising:

molding a rubber composition to form a center having a diameter of about between 1.40" to 1.53" and a weight of about 24 to 34 grams with a deformation of 0.080" to 0.160" when subjected to a load of 200 lbs.;

winding rubber threads about the center to form a core consisting of the center and a thread windings layer; and molding a cover about the core.

2. The method of claim 1 wherein the cover is molded from a member of the group consisting of thermoplastic materials and thermoset materials.

3. The method of claim 2 wherein the center is molded from a rubber based compound, and has a rebound of not less than 70% of it's height when dropped onto a rigid substrate.

4. The method of claim 3 wherein a weight-enhancing material selected from a member of the group consisting of zinc oxide, barium sulfate, tungsten and blends thereof is included in the center.

5. The method of claim 3 wherein the threads are wound to a thickness of between 0.025" and 0.110".

6. The method of claim 3 wherein threads made of a material selected from a member of the group consisting of vulcanized natural rubber, polyisoprene, and blends thereof are wound around the center.

7. The method of claim 3 wherein the core is covered with a material selected from a member of the group consisting of thermoset material and thermoplastic material to form the cover wherein the hardness range of the cover is between about 40 to 70 Shore D.

8. The method of claim 7 wherein the core is covered with polyurethane.

9. The method of claim 3 wherein the threads are wound to form a thread windings layer having a thickness of between 0.025" and 0.110", such that the diameter of the core is between 1.45 and 1.62 inches.

10. The method of claim 3 wherein the center is formed from a rubber composition comprising:

80–100 PPHR of high-cis polybutadiene;

0–20 PPHR of the total weight of the center of natural rubber or polyisoprene;

10–30 PPHR of zinc acrylate salt;

0–50 PPHR of weight-enhancing materials; and, 0.0–5.0 PPHR of curatives.

11. The method of claim 10 wherein the center is cured with a sulfur-based cure system.

12. The method of claim 10 wherein the center is cured with a peroxide-based cure system selected from a member of the group consisting of peroxyketals, peroxyesters, dialkyl peroxides and blends thereof.

13. The method of claim 10 wherein the center is cured with a sulfur-based cure system selected from a member of the group consisting of elemental sulfur, chemical accelerators and blends thereof.

14. The method of claim 10 wherein weight-enhancing materials having a specific gravity of about 4.3 or greater are included in the center.

* * * * *